US009211586B1

(12) United States Patent
Lavernia et al.

(10) Patent No.: US 9,211,586 B1
(45) Date of Patent: Dec. 15, 2015

(54) NON-FACETED NANOPARTICLE REINFORCED METAL MATRIX COMPOSITE AND METHOD OF MANUFACTURING THE SAME

(75) Inventors: Enrique J. Lavernia, Davis, CA (US); Julie M. Schoenung, Davis, CA (US); Yizhang Zhou, Sacramento, CA (US); Zhihui Zhang, Katy, TX (US); Ying Li, Albuquerque, NM (US); Troy Topping, Carmichael, CA (US); Rustin Vogt, Sacramento, CA (US); Deepak Kapoor, Rockaway, NJ (US); Joseph Paras, Lake Hiawatha, NJ (US); Christopher Haines, Union, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 882 days.

(21) Appl. No.: 13/404,139

(22) Filed: Feb. 24, 2012

Related U.S. Application Data

(60) Provisional application No. 61/446,521, filed on Feb. 25, 2011.

(51) Int. Cl.

| | |
|---|---|
| ***B22F 3/12*** | (2006.01) |
| ***B22F 3/10*** | (2006.01) |
| ***B22F 3/15*** | (2006.01) |
| ***B22F 1/00*** | (2006.01) |
| ***B22F 3/105*** | (2006.01) |
| ***B22F 3/17*** | (2006.01) |
| ***B22F 3/18*** | (2006.01) |
| ***B22F 3/20*** | (2006.01) |
| *B22F 9/04* | (2006.01) |

(52) U.S. Cl.
CPC ..... *B22F 3/1017* (2013.01); *B22F 1/0044* (2013.01); *B22F 3/105* (2013.01); *B22F 3/12* (2013.01); *B22F 3/15* (2013.01); *B22F 3/17* (2013.01); *B22F 3/18* (2013.01); *B22F 3/20* (2013.01); *B22F 9/04* (2013.01); *B22F 2998/10* (2013.01)

(58) Field of Classification Search
USPC ..... 419/32
See application file for complete search history.

(56) References Cited

U.S. PATENT DOCUMENTS

2006/0153728 A1* 7/2006 Schoenung et al. ..... 419/32
2007/0151639 A1* 7/2007 Oruganti et al. ..... 148/677

OTHER PUBLICATIONS

Zhihui Zhang, et al., "Mechanical Behavior of Ultrafine-Grained Al Composites Reinforced with B4C Nanoparticles", Scripta Materialia, 65, 2011, pp. 652-655.

* cited by examiner

*Primary Examiner* — George Wyszomierski
*Assistant Examiner* — Ngoclan T Mai
(74) *Attorney, Agent, or Firm* — Henry S. Goldfine

(57) ABSTRACT

A non-faceted nanoparticle reinforced metal matrix composite having increased ductility, while maintaining strength. In particular, a non-faceted nanoparticle reinforced metal matrix composite is provided comprised of spherical or ellipsoidal shaped (non-faceted) nanoparticles comprising one or more of boron carbide, titanium diboride, silicon nitride, alumina and boron nitride, and a nanostructured matrix composite comprised of one or more metals and/or metal alloys. In addition, a method of manufacturing such a non-faceted nanoparticle reinforced metal matrix composite is provided.

3 Claims, 12 Drawing Sheets

NON-FACETED NANOPARTICLE REINFORCED METAL MATRIX COMPOSITE AND METHOD OF MANUFACTURING THE SAME

RELATION TO RELATED APPLICATION

The present application is a non-provisional application of co-pending U.S. provisional application Ser. No. 61/446,521, filed Feb. 25, 2012, the contents of which are incorporated herein by reference.

STATEMENT OF GOVERNMENT INTEREST

The invention described herein may be manufactured, used, imported, sold, and licensed by or for the Government of the United States of America without the payment or any royalty thereon or therefor.

BACKGROUND OF THE INVENTION

1. Field of the Invention

The present invention provides a non-faceted nanoparticle reinforced metal matrix composite having increased ductility, while maintaining strength. In particular, a non-faceted nanoparticle reinforced metal matrix composite is provided comprised of spherical or ellipsoidal shaped (non-faceted) nanoparticles comprising one or more of boron carbide, titanium diboride, silicon nitride, alumina and boron nitride, and a nanostructured matrix composite comprised of one or more metals and/or metal alloys. In addition, a method of manufacturing such a non-faceted nanoparticle reinforced metal matrix composite is provided.

2. Description of the Related Art

Particulate reinforced aluminum matrix composites have high strength, high modulus, lightweight, good performance at high temperature, excellent fatigue resistance, creep resistance and abrasion resistance. The properties of the matrix composites are determined by the reinforcing candidates and by the microstructure of the matrix. Boron carbide ($B_4C$) is a good reinforcing candidate for the aluminum matrix composite, ranking third in hardness (just after diamond and cubic boron nitride) and having a low density of 2.51 g/cm$^3$ (lighter than Al). The microstructure of the matrix is also important to the overall properties of the composites, such as the gain size of the matrix material. For example, for a monolithic metal alloy, the strength of the alloy increases with the decreasing of the grain size. Thus, if a nanostructured Al matrix is achieved, the strength of the composite material can be further improved.

Al-based composite with the nanostructured Al matrix reinforced by the hard $B_4C$ particles can be fabricated via cryomilling. Nanostructured material is material with a microstructure the characteristic length of which is on the order of a few (typically 1-550) nanometers. Microstructure refers to the chemical composition, the arrangement of the atoms (the atomic structure), and the size of a solid in one, two, or three dimensions. Nanostructured materials have received increasing attention due to their superior physical and mechanical properties. They are used in the electronic industry, telecommunication, electrical, magnetic, structural, optical, catalytic, drug delivery, and in consumer goods.

Nanostructured materials have generally conventionally been produced by (1) powder metallurgy, (2) deposition to bulk nanostructured materials, and (3) structural refinement by severe plastic deformation. In powder metallurgy processes, nanostructured materials are commonly made via mechanical milling of powder and subsequent consolidation of the powder into bulk material. There are several disadvantages with this approach. For example, contamination is unavoidable during consolidation.

Modification of these methods, however, can lead to the development of processes that are more practical. For instance, it has been reported that mechanical milling under liquid nitrogen can prevent the powders from being severely oxidized from air, and small nitride or oxy-nitride particles, which are within the size of 2-10 nm, are produced in-situ during milling. These inclusions (including precipitates, dispersoids and constituent particles), as they are called, can both strengthen the metal and enhance the thermal stability (i.e., control the gain growth) of the nanostructured materials. As another example, if the temperature and/or period to consolidate nanostructured powders into fully dense bulk materials can be reduced, severe grain growth can be suspended and thus the nanostructure can again be retained.

With chemical processes, nanostructured materials are created from a reaction with organometallics that precipitate particles of varying sizes and shapes. The process can, however, introduce excess carbon and/or nitrogen into the final composition. An alternative approach is the solution-gelation (sol-gel) process where ceramic product ion is similar to organometallic processes, except sol-gel materials may be either organic or inorganic. Both approaches involve a high cost of raw materials and capital equipment, limiting their commercial acceptance.

Physical or thermal processing involves the formation and collection of nanoparticles through the rapid cooling of a supersaturated vapor (gas phase condensation, see U.S. Pat. No. 5,128,081). Thermal processes create the supersaturated vapor in a variety of ways, including laser ablation, plasma porch synthesis, combustion flame, exploding wires, spark erosion, electron beam evaporation, sputtering (ion collision). In laser ablation, for example, a high-energy pulsed laser is focused on a target containing the material to be processed. The high temperature of the resulting plasma (greater than 10,000° K) vaporizes the material quickly allowing the process to operate at room temperature. The process is capable of producing a variety of nanostructured materials on the laboratory scale, but it has the disadvantage of being extremely expensive due to the inherent energy inefficiency of lasers, and, therefore, is not suitable for industrial scale production.

Mechanical milling has been widely used to fabricate nanostructured metal powder and powder for metal matrix composites. However, it can be difficult to obtain nanostructured aluminum alloys with conventional mechanical milling, because of the high recrystallization rate due to the low melting temperature of aluminum. Cryogenic milling or cryomilling is a modified mechanical milling technique where the mechanical milling is carried out at cryogenic temperatures, usually in liquid nitrogen or a similar chilled atmosphere. Cryomilling has been employed to successfully fabricate nanostructured aluminum alloy powders and powders for aluminum metal matrix composites, which exhibit good thermal stability, because the cryogenic temperature retards the recovery of the aluminum. Strain is accumulated during cryomilling, leading to dislocation activity, ultimately causing the formation of nanoscaled grains within the cryomilled powder.

The combined effect of the ultra-fine dispersion of particles formed during cryomilling and the reduced grain size is a powder that can be used to make a bulk material with relatively high strength. This type of material will also exhibit better creep resistance compared to its conventional counterpart. It has been reported that cryomilled aluminum alloys and aluminum metal matrix composite powders have nanoscaled structures with very good thermal stability. Also, cryomilling can be easily scaled up to produce tonnage quantities. Thus, cryomilling is one of the few processing approaches available for the fabrication of large quantities of nanostructured metal powders.

The nanostructured powders described above must be consolidated into bulk materials. Traditional consolidation approaches, such as hot pressing (HP), hot isostatic pressing (HIP), and cold isostatic pressing (CIP) have been employed for consolidation into bulk materials. U.S. Patent Application Publication No. 2004/0065173 to Fritzmeier et al. discloses aluminum alloy produced by blending aluminum with two other metals by cryomilling. The cryomilled alloy is subsequently consolidated by HIP. These consolidation methods require other gases to improve the efficiency of consolidation. Further, these traditional consolidation approaches need very high pressures, on the order of GPa, which is provided by high-pressure argon, and long cycle time that can last for several hours.

Cryomilling has been demonstrated to provide a homogeneous distribution of the $B_4C$ in the Al matrix and a good interface between the $B_4C$ and the Al matrix. However, the $B_4C$/Al nanocomposite fabricated by cryomilling and subsequent consolidation approach exhibited limited ductility despite the high strength. Therefore, there is a need for a strong, yet highly ductile reinforced metal matrix composite, and a process for making such particulate reinforced matrix composites.

SUMMARY OF THE INVENTION

In order to achieve the objects of the present invention, as discussed above, the present inventors endeavored to develop a non-faceted nanoparticle reinforced metal matrix composite and method of manufacturing same. In particular, in a first general embodiment of the present invention, a non-faceted nanoparticle reinforced metal matrix composite is provided comprising 0.5-40 wt % of non-faceted nanoparticles comprising one or more of boron carbide, titanium diboride, silicon nitride, alumina and boron nitride; and 60-99.5 wt % of a nanostructured matrix composite comprised of one or more metals and/or metal alloys. Preferably, a majority of the non-faceted nanoparticles have a spherical or ellipsoidal shape, which has been found to provide an increased surface area, unexpectedly improved load transfer and unexpectedly diminished stress concentration and interaction between the non-faceted nanoparticles and the nanostructured matrix composite.

In a first preferred embodiment, the non-faceted nanoparticle reinforced metal matrix composite of the first general embodiment above, the composite comprises 0.5-20 wt % of the non-faceted nanoparticles, and 80-99.5 wt % of the nanostructured matrix composite. More preferably, the composite comprises 0.5-10 wt % of the non-faceted nanoparticles, and 90-99.5 wt % of the nanostructured matrix composite.

In a second preferred embodiment, the non-faceted nanoparticles of the first general embodiment above have an average diameter of from about 1 to about 100 nm. Preferably, the non-faceted nanoparticles have an average diameter of from about 30 to about 70 nm.

In a third preferred embodiment, in the non-faceted nanoparticle reinforced metal matrix composite of the first general embodiment above, the nanostructured matrix composite comprises one or more of aluminum, magnesium, titanium, nickel, cobalt, iron, niobium, molybdenum, copper, tungsten, tantalum, and alloys thereof. The one or more metals and/or metal alloys mentioned above are milled, unmilled or a mixture thereof.

In a fourth preferred embodiment, the nanostructured matrix composite of the first general embodiment above has an average grain size of from about 10 to about 800 nm.

In a fifth preferred embodiment, the nanostructure matrix composite of the first general embodiment above further comprises one or more ceramic compositions. Preferably, the ceramic composition(s) is one or more of an oxide, carbide, nitride, boride and chalcogenide.

In a sixth preferred embodiment, the nanostructure matrix composite of the first general embodiment above further comprises one or more intermetallic composition. Preferably, the intermetallic composition is one or more of an aluminide and silicide.

In a seventh preferred embodiment, the nanostructure matrix composite of the first general embodiment above further comprises both a ceramic composition and an intermetallic composition.

In a second general embodiment of the present invention, a method of producing a non-faceted nanoparticle reinforced metal matrix composite is provided comprising:

(a) a blending step comprising blending 0.5-40 wt % of non-faceted nanoparticles comprising one or more of boron carbide, titanium diboride, silicon nitride, alumina and boron nitride, and 60-99.5 wt % of a nanostructured matrix composite material comprised of one or more metals and/or metal alloys, so as to produce a first blend mixture;

(b) a milling step comprising cryomilling the first blend mixture;

(c) a degassing step comprising hot vacuum degassing the cryomilled first blend mixture produced in step (b), so as to produce a second blend mixture;

(d) a primary consolidation step comprising consolidating the second blend mixture, so as to form an initial consolidated reinforced metal matrix composite material; and (e) a secondary consolidation step comprising further consolidating the initial consolidated reinforced metal matrix composite material, so as to form a final reinforced metal matrix composite material.

(f) In a first preferred embodiment based on the method of producing a non-faceted nanoparticle reinforced metal matrix composite of the second general embodiment above, after step (b), unmilled powders are blended with the cyromilled first blend mixture prior to hot vacuum degassing.

In a second preferred embodiment based on the method of producing a non-faceted nanoparticle reinforced metal matrix composite of the second general embodiment above, the primary consolidation step is carried out via one or more of hot pressing (HP), hot isostatic pressing (HIP), cold isostatic pressing (CIP), sintering, spark plasma sintering (SPS), laser engineered nets shape (LENS), and quasi-isostatic forging (QIF).

In a third preferred embodiment based on the method of producing a non-faceted nanoparticle reinforced metal matrix composite of the second general embodiment above, the secondary consolidation step is carried out via one or more of forging, extrusion, rolling and QIF.

Additional aspects of the invention will be set forth in part in the description which follows, and in part will be obvious from the description. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 12:
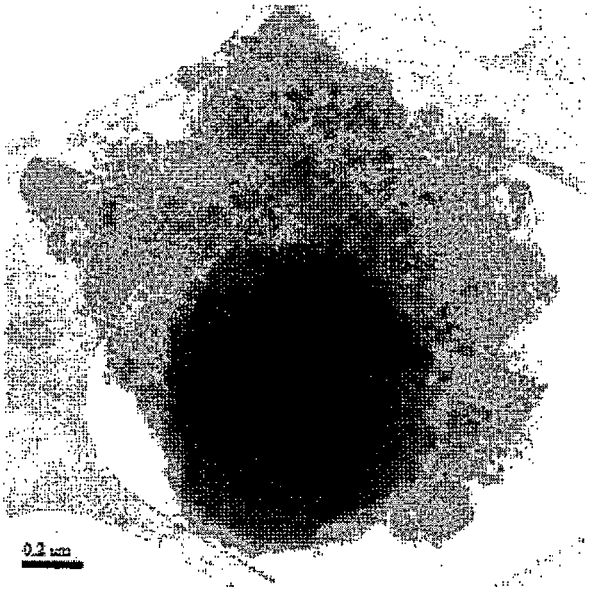
FIG. 12 is an SEM photograph of non-faceted nanoparticles of boron carbide according to the present invention.
Figure 13:
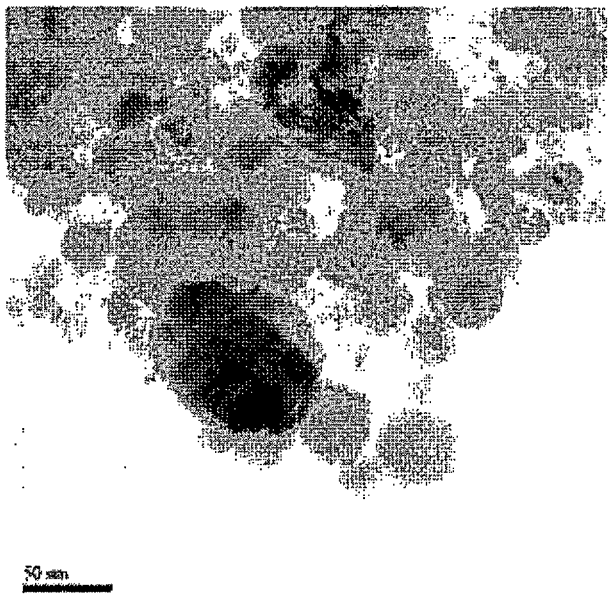
FIG. 13 is an SEM photograph of non-faceted nanoparticles of boron carbide according to the present invention.
Figure 14:
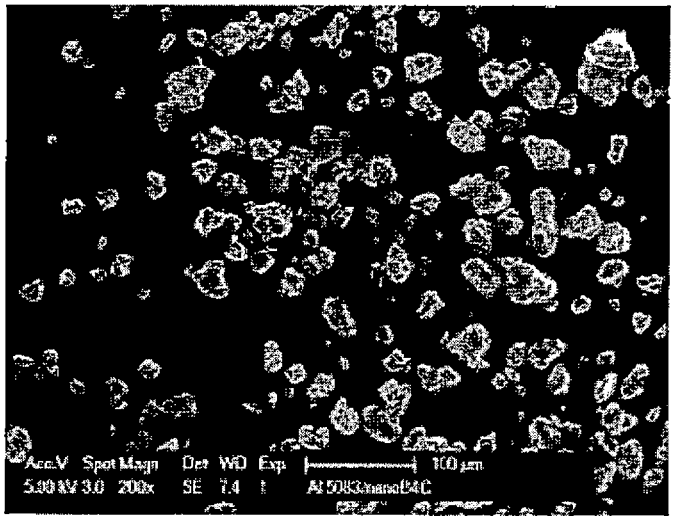
FIG. 14 is an SEM photograph of cryomilled Al and boron carbide nanoparticles used in forming the reinforced metal matrix composite of the present invention, illustrating the morphology of the cryomilled powder.
Figure 15:
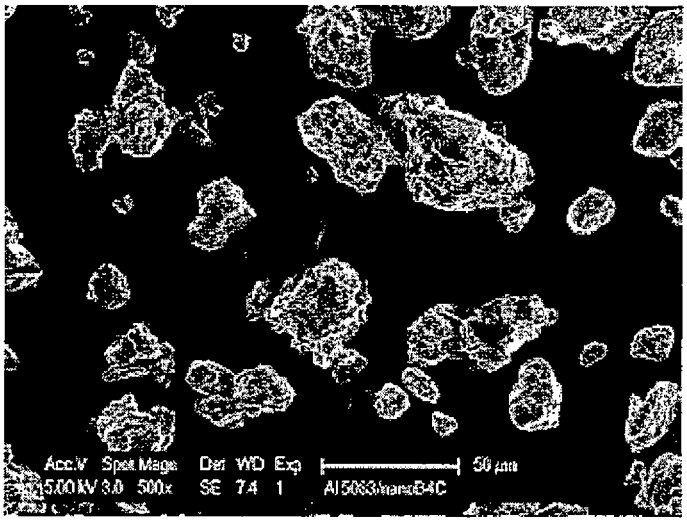
FIG. 15 is an enlarged image of a portion of the SEM photograph of cryomilled Al and boron carbide nanoparticles shown in FIG. 14, illustrating in greater detail the morphology of the cryomilled powder.
Figure 16:
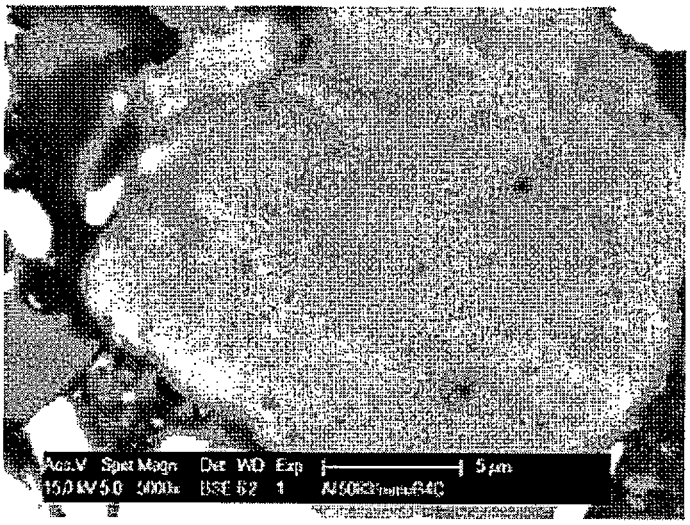
FIG. 16 is an SEM photograph of a nanoparticle making up the metal matrix composite of the present invention, illustrating the distribution of the boron carbide (shown as dark grey particles) in the Al, and the generally spherical or ellipsoidal shapes of the particles.
Figure 17:
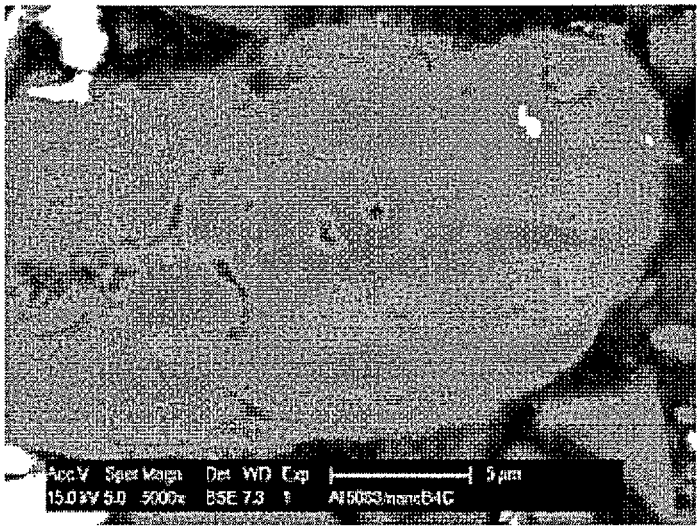
FIG. 17 is another SEM photograph of a nanoparticle making up the metal matrix composite of the present invention, illustrating the distribution of the boron carbide (shown as dark grey particles) in the Al, and the generally spherical or ellipsoidal shapes of the particles.
Figure 18:
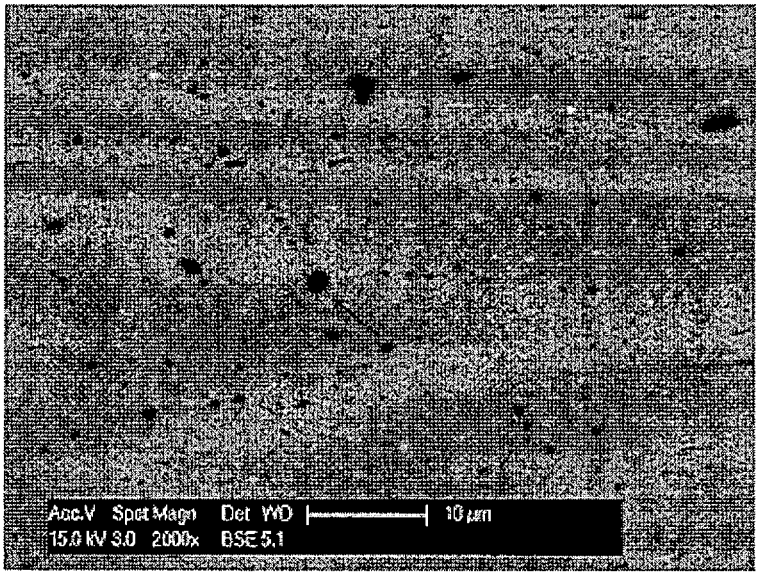
FIG. 18 is an SEM photograph of an extruded metal matrix composite of the present invention, illustrating the distribution of the Al—Cr—Mn—Fe (shown as white particles) in the composite, and the distribution of boron carbide (shown as dark particles).
Figure 19:
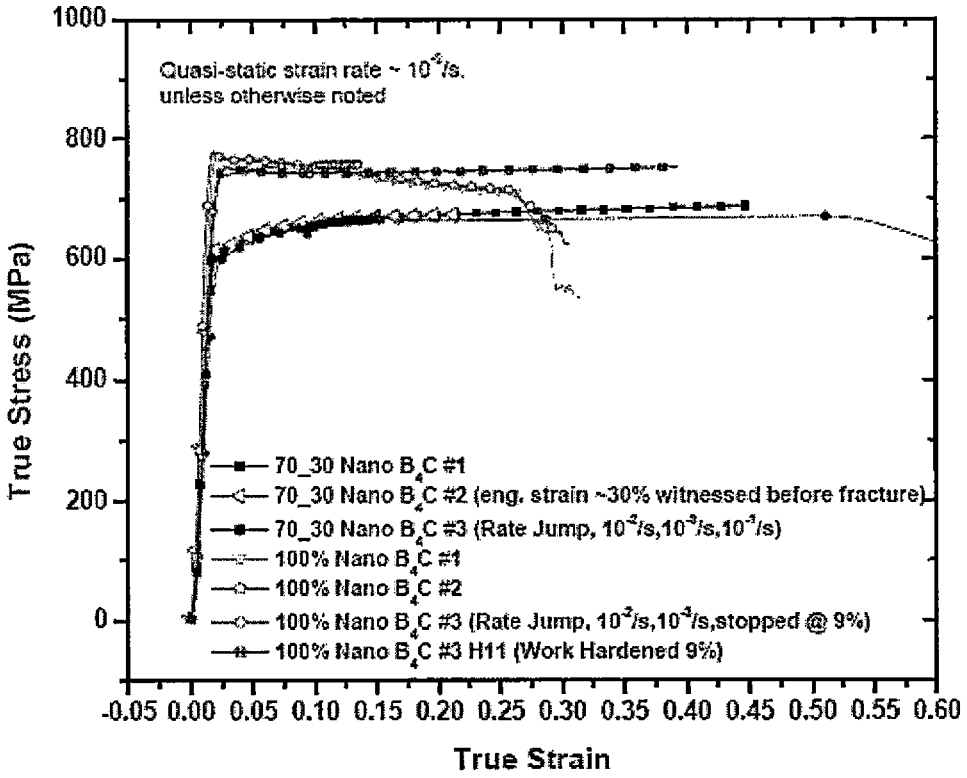
FIG. 19 is a graph illustrating compressive true stress vs. true strain on various reinforced metal matrix composite materials of the present invention.

As mentioned above, and as illustrated in FIG. 18, the present invention provides a non-faceted nanoparticle reinforced metal matrix composite is provided, which is comprised of 0.5-40 wt % of non-faceted nanoparticles and 60-99.5 wt % of a nanostructured matrix composite comprised of one or more metals and/or metal alloys. As illustrated in FIGS. 12, 13 and 17, a majority of the non-faceted nanoparticles have a spherical or ellipsoidal shape. The present inventors, through experimentation, have found that such non-faceted nanoparticle shape increases surface area, improves load transfer and diminishes stress concentration and interaction between the non-faceted nanoparticles and the nanostructured matrix composite, leading to a stronger and more ductile composite material.

The non-faceted nanoparticles are comprised of one or more of boron carbide, titanium diboride, silicon nitride, alumina and boron nitride. As mentioned above, the reinforced metal matrix composite is comprised of 0.5-40 wt % of same. Preferably, however, the non-faceted nanoparticles are present in an amount of 0.5-20 wt %, based on the total weight of the composite, with the remaining being the metal/metal alloy component. Most preferably, the composite comprises 0.5-10 wt % of the non-faceted nanoparticles, and 90-99.5 wt % of the nanostructured matrix composite.

As illustrated in FIGS. 12, 13, 16 and 18, the non-faceted nanoparticles of the first general embodiment above have an average diameter of from about 1 to about 100 nm. Preferably, the non-faceted nanoparticles have an average diameter of from about 30 to about 70 nm.

Figure 1:
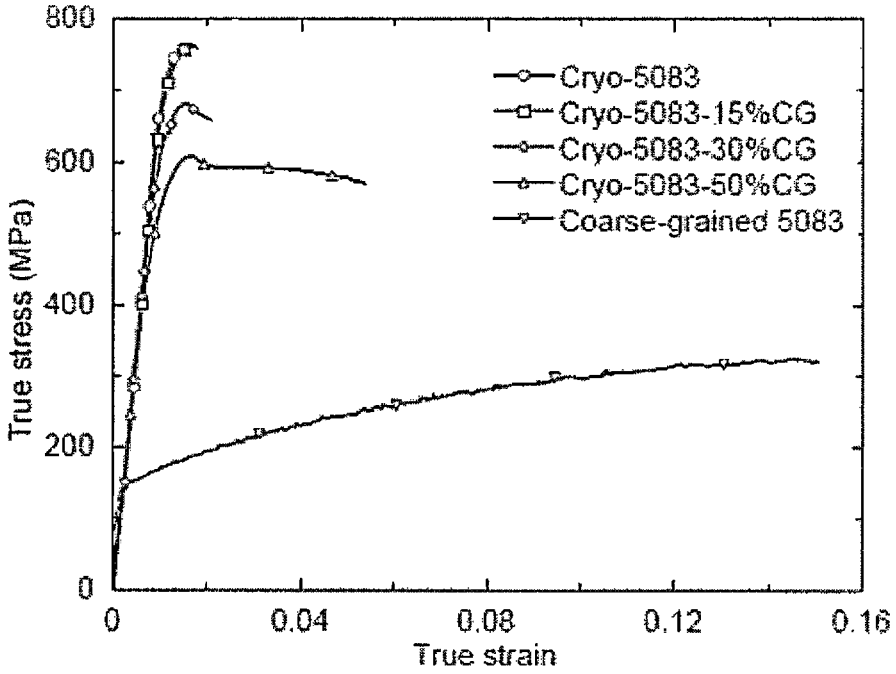
FIG. 1 is a graph illustrating tensile true stress vs. true strain on a composite material comprised of cryomilled Al blended with unmilled Al.
Figure 2:
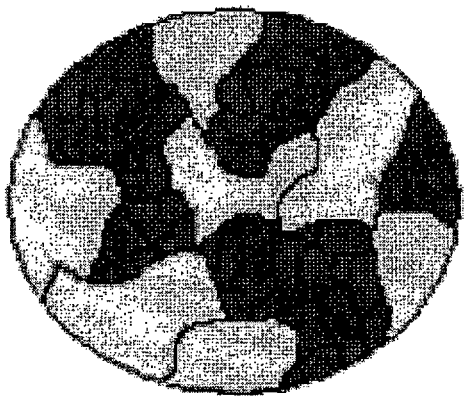
FIG. 2 is an illustration of a particle of composite material comprised of cryomilled Al blended with unmilled Al.
Figure 3:
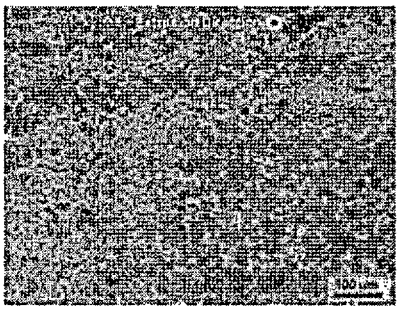
FIG. 3 is an SEM (scanning electron micrograph) image of an extruded composite material comprised of 70 wt % of cryomilled Al blended with 30 wt % of unmilled Al.
Figure 4:
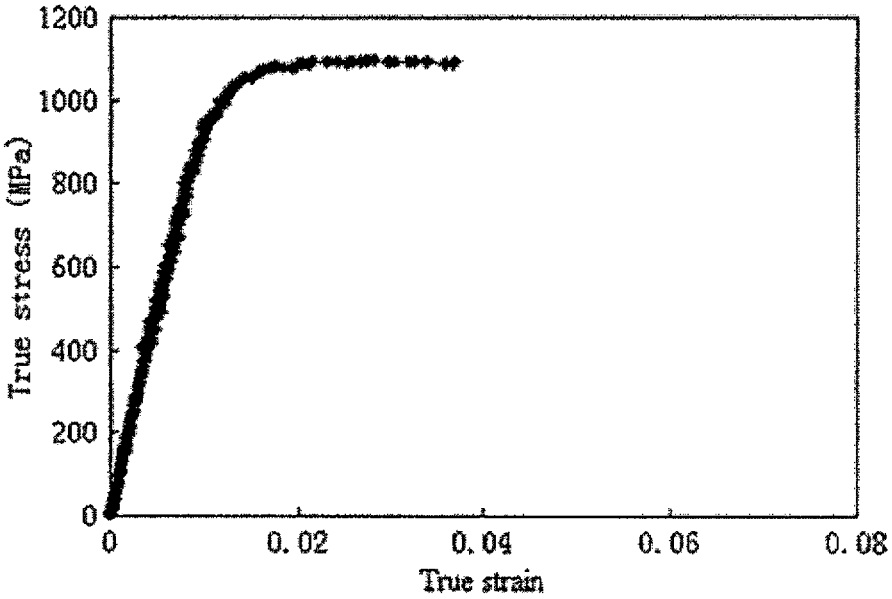
FIG. 4 is a graph illustrating compressive true stress vs. true strain on a composite material comprised of cryomilled Al blended with a blend of boron carbide ($B_4C$) of the F1200 variety (i.e., being on the 1-6 micron scale and faceted in geometry) and unmilled Al.
Figure 5:
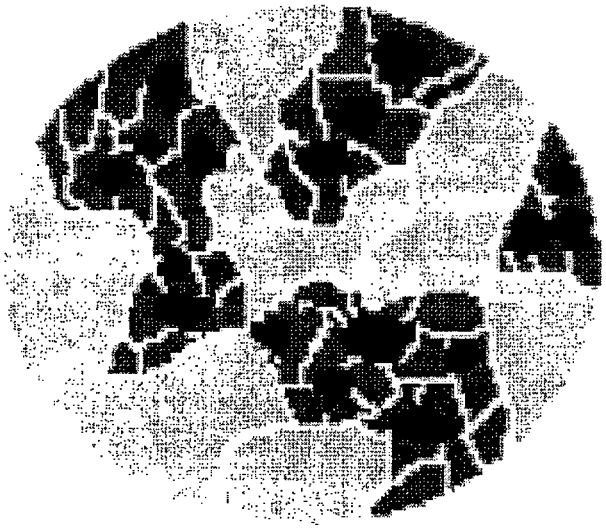
FIG. 5 is an illustration of a particle of composite material comprised of cryomilled Al blended with a blend of boron carbide ($B_4C$) of the F1200 variety and unmilled Al.
Figure 6:
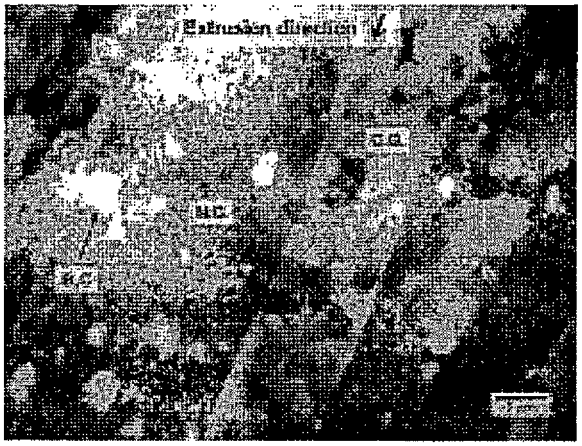
FIG. 6 is an SEM (scanning electron micrograph) image of a composite material comprised of extruded cryomilled Al blended with a blend of boron carbide ($B_4C$) of the F1200 variety and unmilled Al.
Figure 7:
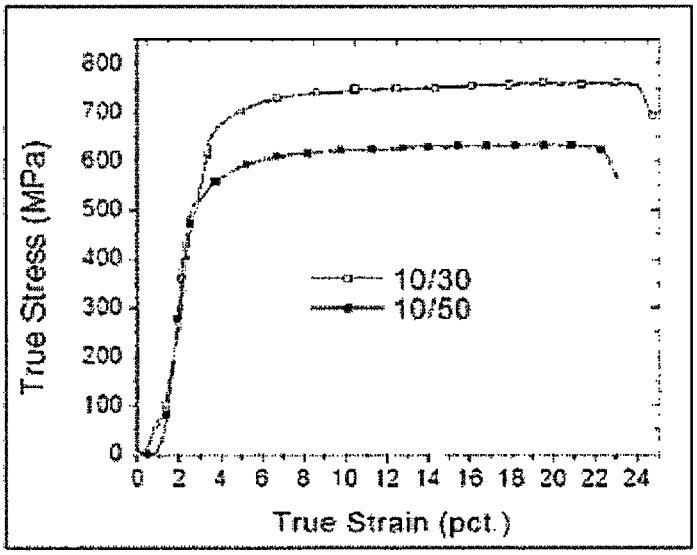
FIG. 7 is a graph illustrating compressive true stress vs. true strain on two composite materials, one comprised of 40 wt % cryomilled Al, 10 wt % boron carbide ($B_4C$) of the F1200 variety and 50 wt % unmilled Al, and the other comprised of 60 wt % cryomilled Al, 10 wt % boron carbide ($B_4C$) and 30 wt % unmilled Al.
Figure 8:
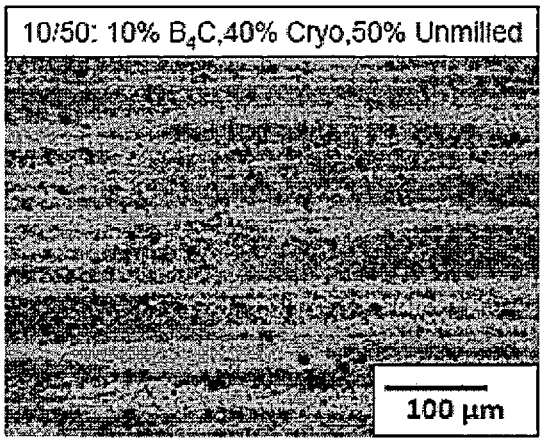
FIG. 8 is an SEM (scanning electron micrograph) image of a composite material formed by being hot isostatic pressing, extrusion and compression comprising 40 wt % cryomilled 10 wt % boron carbide ($B_4C$) of the F1200 variety and 50 wt % unmilled Al.
Figure 9:
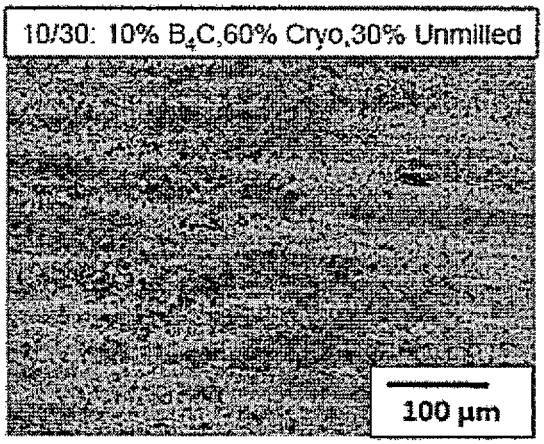
FIG. 9 is an SEM (scanning electron micrograph) image of a composite material formed by hot isostatic pressing, extrusion and compression comprising 60 wt % cryomilled Al, 10 wt % boron carbide ($B_4C$) of the F1200 variety and 30 wt % unmilled Al.
Figure 10:
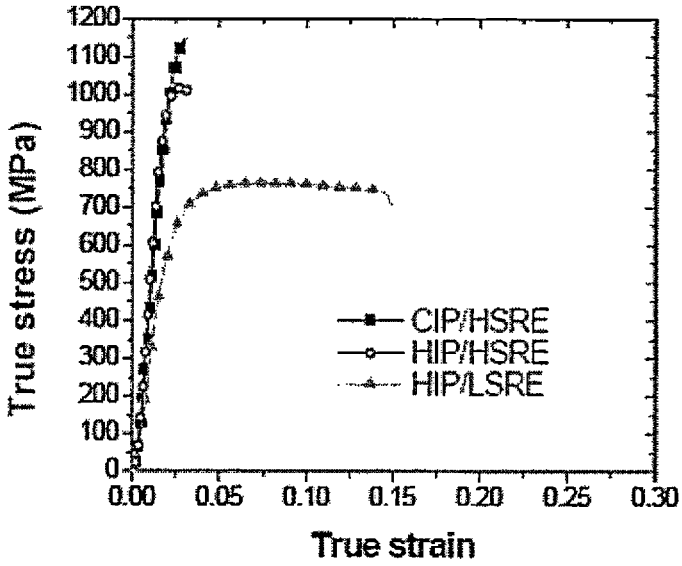
FIG. 10 is a graph illustrating compressive true stress vs. true strain on three composite materials of the present invention comprised of 60 wt % cryomilled Al, 10 wt % boron carbide ($B_4C$) of the F1200 variety and 30 wt % unmilled Al, which were extruded.
Figure 11:
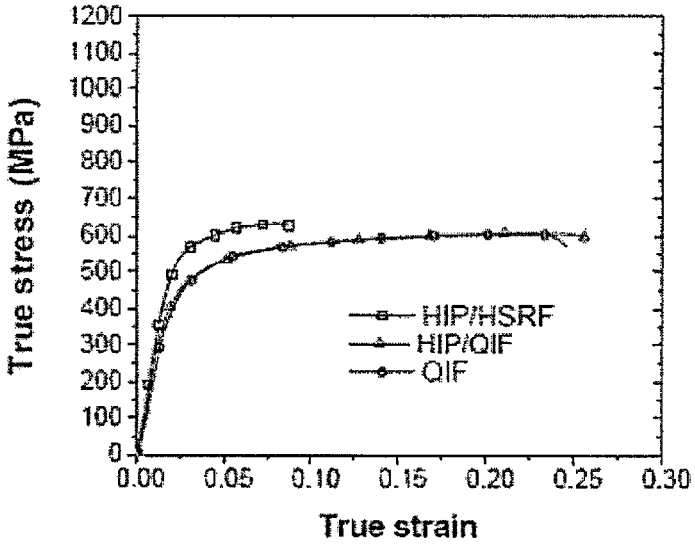
FIG. 11 is a graph illustrating compressive true stress vs. true strain on three composite materials of the present invention comprising 40 wt % cryomilled Al, 10 wt % boron carbide ($B_4C$) of the F1200 variety and 50 wt % unmilled Al, which were forged.

As mentioned above, the nanostructured matrix composite is comprised of one or more metals and/or metal alloys. In particular, the nanostructured matrix composite is made up of one or more of aluminum, magnesium, titanium, nickel, cobalt, iron, niobium, molybdenum, copper, tungsten, tantalum, and alloys thereof. In the non-faceted nanoparticle reinforced metal matrix composite, the nanostructured matrix composite component has an average grain size of from about 10 to about 800 nm, as illustrated in FIGS. 8 and 9. Further, these metals and/or metal alloys making up the nanostructured matrix composite may be milled, unmilled or a mixture thereof. For example, as illustrated in FIG. 2, milled and unmilled Al may be combined, the true stress v. true strain of a composite thereof being illustrated in FIG. 1.

However, in a preferred embodiment, as illustrated in FIGS. 14-19, a mixture of milled aluminum and unmilled metal/metal alloy, in combination with the non-faceted nanoparticles, is provided by the present invention. In a preferred embodiment, milled and unmilled aluminum, in combination with boron carbide, is utilized to form the non-faceted nanoparticle reinforced metal matrix composite. As illustrated, such a non-faceted nanoparticle reinforced metal matrix composite exhibits unexpectedly improved strength while also providing surprisingly high ductility.

In a further preferred embodiment, the nanostructure matrix composite of the present invention comprises one or more ceramic compositions. Preferably, the ceramic composition(s) is one or more of an oxide, carbide, nitride, boride and chalcogenide. In another preferred embodiment, the nanostructure matrix composite of the present invention may further comprise one or more intermetallic composition. Preferably, the intermetallic composition is one or more of an aluminide and silicide. Alternatively, the nanostructure matrix composite may comprise both a ceramic composition and an intermetallic composition.

Method of Manufacture

As mentioned above, the present inventors have developed a method of producing the non-faceted nanoparticle reinforced metal matrix composite mentioned above. In particular, generally, such a method is comprised of the steps of (a) blending 0.5-40 wt % of non-faceted nanoparticles comprising one or more of boron carbide, titanium diboride, silicon nitride, alumina and boron nitride, and 60-99.5 wt % of a nanostructured matrix composite material comprised of one or more metals and/or metal alloys, so as to produce a first blend mixture;

(b) cryomilling the first blend mixture;

(c) hot vacuum degassing the cryomilled first blend mixture produced in step (b), so as to produce a second blend mixture;

(d) consolidating the second blend mixture, so as to form an initial consolidated reinforced metal matrix composite material; and (e) further consolidating the initial consolidated reinforced metal matrix composite material, so as to form a final reinforced metal matrix composite material.

Preferably, after step (b), unmilled powders are blended with the cyromilled first blend mixture prior to hot vacuum degassing.

In a second preferred embodiment based on the method of producing a non-faceted nanoparticle reinforced metal matrix composite of the second general embodiment above, the primary consolidation step is carried out via one or more of hot pressing (HP), hot isostatic pressing (HIP), cold isostatic pressing (CIP), sintering, spark plasma sintering (SPS), laser engineered nets shape (LENS), and quasi-isostatic forging (QIF).

In a third preferred embodiment based on the method of producing a non-faceted nanoparticle reinforced metal matrix composite of the second general embodiment above, the secondary consolidation step is carried out via one or more of forging, extrusion, rolling and QIF.

Additional aspects of the invention will be set forth in part in the description which follows, and in part will be obvious from the description. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

Test Examples

Nanometric (~50 nm) $B_4C$ reinforced Al composited were prepared via cryomilling in liquid nitrogen for 12 hours to ensure dispersion of target composition of vol. % (4.7 wt. %) $B_4C$ in an Al 5083 matrix. After cryomilling, powders were v-blended (for the 70/30) composition), canned and hot vacuum degassed. Subsequent to degassing materials were hot isostatic pressed (HIPped) and low strain rate extruded (LSRE) at 400° C. at UC Davis.

For quasi-static ($\acute{\epsilon}$~$10^{-3}$/s) compression tests, cylindrical coupons of approximately 6 mm diameter×8 mm height were machined and polished via conventional lathe. Testing was performed on an Instron® 8801 test frame equipped with a standard video extensometer for strain measurement. Since strain cannot be measured directly on the coupon, witness marks were made on tungsten carbide platens directly adjacent to the actual specimen (to minimize compliance effects). Platens were lubricated to minimize barreling of the specimens.

SEM samples were prepared using a JEOL SM-09010 ion cross-sectional polisher and imaged on an FBI XL30 SEM. TEM samples were prepared using a Gatan Ion mill and imaged on a Philips CM 12 at 100 kV.

The results of these stress vs. strain tests, as well as the stress vs. strain tests shown in the Figures herein, illustrated that nano-$B_4C$ reinforced Al composites comprised of cryomilled and unmilled Al particles were more ductile while retaining higher strength in comparison to 100% cryomilled Al 5083 and conventional Al 5083 that were not reinforced with nanoparticles. Further, it was discovered that extrusion provided a more desirable composite than forging. Lastly, it was discovered that the shape of the nanoparticles, i.e., spherical or ellipsoidal, is an important factor in providing increased strength and ductility to the composite.

Figure 20:
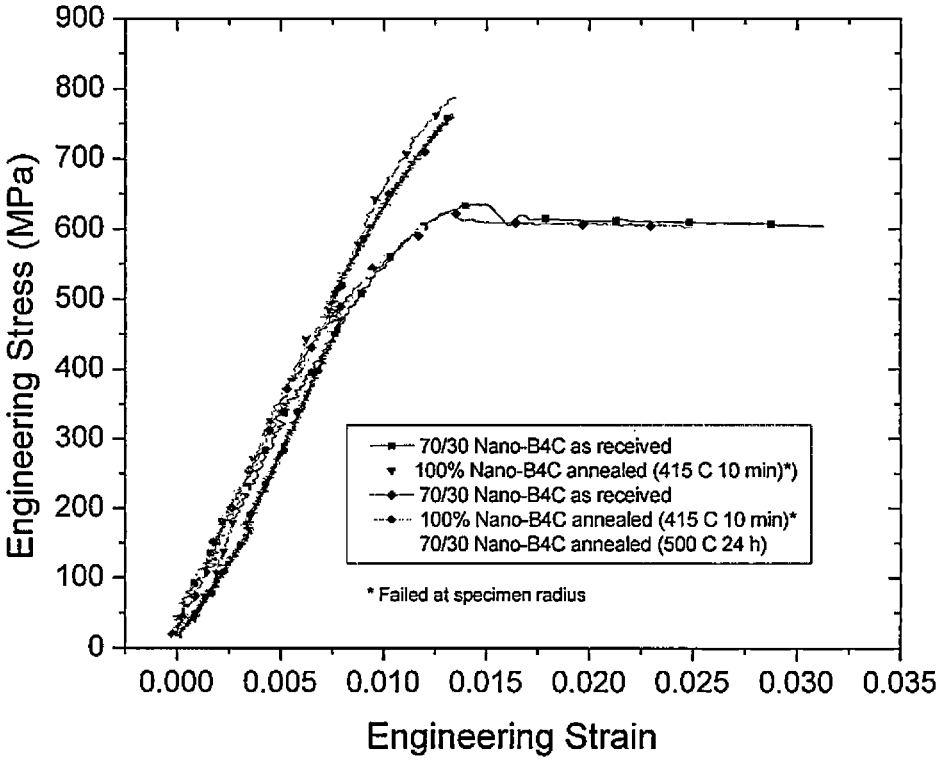
FIG. 20 is a graph illustrating tensile engineering stress vs. engineering strain for five non-faceted nanoparticle reinforced metal matrix composites of the present invention.

Further, as shown in FIG. 20, five different composites were prepared, and specimens of each were threaded, cylindrical ASTM 8 subsize with 0.125" diameter×0.5" gauge section. Then, the tensile strength of these five different composite samples was measured via engineering stress vs. engineering strain tests conducted on Instron 8801 universal testing machine equipped with standard video extensometer. As illustrated in FIG. 20, the nano-reinforced composites (70/30 nano $B_4C$) according to the present invention, exhibited sufficient tensile strength over a much broader range of applied strain.

Figure 21:
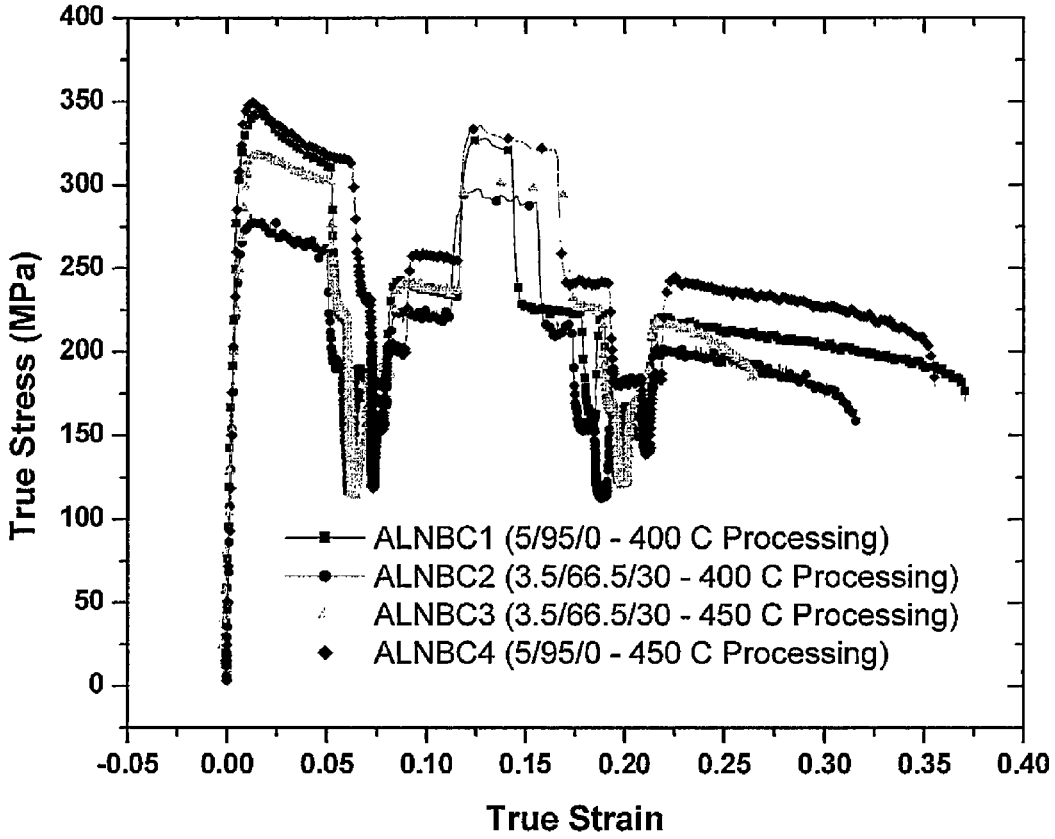
FIG. 21 is a graph illustrating tensile true stress vs. true strain for five non-faceted nanoparticle reinforced metal matrix composites of the present invention, illustrating measured strain vs. stress of the composites during tensile stress tests conducted at 200° C.

In addition, four nano-$B_4C$ reinforced Al composites of the present invention were prepared and subjected to similar strain rate jump tests at $10^{-3}$/s, $10^{-4}$/s, $10^{-5}$/s, $10^{-4}$/s, $10^{-3}$/s, $10^{-2}$/s, $10^{-3}$/s, $10^{-4}$/s, $10^{-5}$/s, $10^{-4}$/s, and $10^{-3}$/s, respectively, at a temperature of 200° C. The results of these tests are graphed in FIG. 21. As shown therein, the composites of the present invention exhibited unexpectedly high tensile strength over a wide range of applied stress, even at an elevated temperature of 200° C.

Although specific embodiments of the present invention have been disclosed herein, those having ordinary skill in the art will understand that changes can be made to the specific embodiments without departing from the spirit and scope of the invention. Thus, the scope of the invention is not to be restricted to the specific embodiments. Furthermore, it is intended that the appended claims cover any and all such applications, modifications, and embodiments within the scope of the present invention

What is claimed is:

1. A method of producing a non-faceted nanoparticle reinforced metal matrix composite which exhibits improved strength and high ductility comprising:

(a) a blending step comprising blending 0.5-40 wt % of non-faceted nanoparticles comprising one or more of boron carbide, titanium diboride, silicon nitride, alumina and boron nitride, and 60-99.5 wt % of a nanostructured matrix composite material comprised of one or more metals and/or metal alloys, so as to produce a first blend mixture;

(b) a milling step comprising cryomilling the first blend mixture, which cryomilled first blend mixture is mixed with a quantity of one or more unmilled metal and/or metal alloys to form a composite mixture;

(c) a degassing step comprising hot vacuum degassing the composite mixture produced in step (b), so as to produce a second blend mixture;

(d) a primary consolidation step comprising consolidating the second blend mixture, so as to form an initial consolidated reinforced metal matrix composite material; and (e) a secondary consolidation step comprising further consolidating the initial consolidated reinforced metal matrix composite material, so as to form a final reinforced metal matrix composite material;

(f) wherein the quantity of said unmilled metal and/or metal alloys, which is mixed with said first blend mixture, is sufficient to achieve the reinforced metal matrix composite material with the desired strength and ductility.

2. The method of producing a non-faceted nanoparticle reinforced metal matrix composite of claim 1, wherein the primary consolidation step is carried out via one or more of hot pressing (HP), hot isostatic pressing (HIP), cold isostatic pressing (CIP), sintering, spark plasma sintering (SPS), laser engineered nets shape (LENS), and quasi-isostatic forging (QIF).

3. The method of producing a non-faceted nanoparticle reinforced metal matrix composite of claim 1, wherein the secondary consolidation step is carried out via one or more of forging, extrusion, rolling and quasi-isostatic forging (QIF).

* * * * *